US009303402B2

(12) United States Patent
Warren

(10) Patent No.: US 9,303,402 B2
(45) Date of Patent: Apr. 5, 2016

(54) BASEMENT WALL AND FLOOR ASSEMBLY

(71) Applicant: Joseph Warren, Wichita, KS (US)

(72) Inventor: Joseph Warren, Wichita, KS (US)

( * ) Notice: Subject to any disclaimer, the term of this patent is extended or adjusted under 35 U.S.C. 154(b) by 0 days.

(21) Appl. No.: 14/623,927

(22) Filed: Feb. 17, 2015

(65) Prior Publication Data

US 2015/0159373 A1 Jun. 11, 2015

Related U.S. Application Data

(60) Provisional application No. 61/941,109, filed on Feb. 18, 2014.

(51) Int. Cl.

| | |
|---|---|
| ***E04B 1/00*** | (2006.01) |
| ***E04B 2/84*** | (2006.01) |
| ***E04B 1/41*** | (2006.01) |
| ***E04C 3/16*** | (2006.01) |
| ***E04G 11/08*** | (2006.01) |
| ***E04G 15/06*** | (2006.01) |
| ***E04G 13/00*** | (2006.01) |
| *E04G 21/18* | (2006.01) |

(52) U.S. Cl.

CPC ..... *E04B 2/84* (2013.01); *E04B 1/4157* (2013.01); *E04C 3/16* (2013.01); *E04G 11/08* (2013.01); *E04G 13/00* (2013.01); *E04G 15/06* (2013.01); *E04B 2103/02* (2013.01); *E04G 21/185* (2013.01)

(58) Field of Classification Search

CPC ..... E04B 1/10; E04B 1/18; E04B 1/20; E04B 1/26; E04B 1/4157; E04B 2/84; E04B 5/12; E04B 2001/3583; E04B 2103/02; E04G 9/00; E04G 11/08; E04G 15/06; E04C 3/16

See application file for complete search history.

(56) References Cited

U.S. PATENT DOCUMENTS

| | | | | | |
|---|---|---|---|---|---|
| 1,622,962 | A | * | 3/1927 | Michod | 52/210 |
| 4,630,424 | A | * | 12/1986 | Eberle et al. | 52/693 |
| 5,353,560 | A | * | 10/1994 | Heydon | 52/281 |

* cited by examiner

*Primary Examiner* — Patrick Maestri

(74) *Attorney, Agent, or Firm* — Kenneth H. Jack; Davis & Jack, L.L.C.

(57) ABSTRACT

An apparatus for clamping a floor including truss top cords having tongue configured ends and including an overlying sheath having a plurality of bolt receiving apertures, the apparatus incorporating a concrete foundation wall having an upper end forming an outer flange and an inner recess; outer threaded bolts anchored within and extending upwardly from the outer flange and positioned for, upon receipts of the truss's tongue configured ends within the inner recess, extension through the sheath's bolt receiving apertures; and an outer plurality of threaded nuts fitted for engagements with the outer plurality of threaded bolts, the nuts, upon the tongue configured end receipts, upon the bolt extensions, and upon the threaded engagements, clamping the sheath against the outer flange and capturing the tongue configured ends within the inner recess.

8 Claims, 5 Drawing Sheets

BASEMENT WALL AND FLOOR ASSEMBLY

FILED PROVISIONAL PATENT APPLICATION

This non-provisional patent application claims the benefit of and priority from U.S. provisional patent application No. 61/941,109 filed Feb. 18, 2015. The inventor disclosed in and applicant of said provisional application is the same person as the person who is disclosed as the inventor in and applicant of the instant application. The applicant asserts that structures and functions of structures disclosed and described in the instant application are substantially identical to those disclosed in said provisional application.

FIELD OF THE INVENTION

This invention relates to floors and basement or foundation walls of constructed houses and commercial buildings. More particularly, this invention relates to floor supporting interfaces or joints between such floors and their supporting trusses and the building's foundation or basement walls.

BACKGROUND OF THE INVENTION

Conventional cast concrete basement walls or building foundation walls commonly have a flat upper surfaces which present series of embedded and upwardly extending helically threaded lugs. Where floor trusses are provided in the construction of a building which is supported by such basement or foundation wall, lower surfaces of the ends of the trusses' lower cords are commonly supported by and bear directly against such foundation wall upper surfaces. Alternately, an undersurface of truss upper cord hanger tongues may bear directly upon such foundation wall upper surface. Such common foundation wall and floor truss configurations often undesirably raise the entry level of the constructed building above ground level, undesirably interfering with handicapped access. Such configurations also undesirably allow catastrophic wind forces to tear away above ground floor structures including flooring, undesirably exposing basement shelter spaces to incursions of broken structures and debris.

The instant inventive basement wall and floor assembly and method solves or ameliorates the above described drawbacks and deficiencies of conventional floor, truss, and foundation wall combinations by specially configuring the junctures between truss ends and floor edges, and the foundation wall's upper ends.

BRIEF SUMMARY OF THE INVENTION

A first structural component of the instant inventive assembly and method comprises a plurality of vertical sheathings of the type which are conventionally used for forming a building's basement or foundation walls, such sheathings typically comprising interior and exterior panels which form and define a concrete wall casting space.

Further structural components comprise pluralities of inset or step molding or forming boards which are preferably temporarily nailed to the interior surface of the concrete forms' inner sheathings and are positioned at such sheathings' upper ends. Inner sill plate boards are preferably fixedly nailed to the lower surfaces of such step molding boards, and a first plurality of helically threaded "L" bolts preferably extend through bores drilled vertically through such sill plates, such first plurality of "L" bolts extending downwardly therefrom for secure embedded mounting within subsequently poured concrete.

Following construction and interconnection of the step molding boards, sill plates, and helically threaded "L" bolts in the manner described above, the concrete forms may be filled with the concrete in a conventional fashion to a level substantially equal to the upper surface of the uppermost step molding boards. Thereafter, a second plurality of helical threaded "L" bolts may be inserted into the exposed upper surface of the concrete, such insertions positioning the second plurality of "L" bolts outwardly and upwardly from the first plurality of "L" bolts. Suitably, wedge anchor bolts having helically threaded upper ends may be installed following concrete hardening. Following hardening of the concrete, the interior and exterior concrete forming sheathings may be removed, and the step molding boards may be removed. Such disassembly steps advantageously leave in place the sill plates which are securely embedded within and held at the lower end of the molded step. Such disassembly also leaves in place the lower/inner and upper/outer pluralities of helically threaded "L" bolts, such bolts facilitating subsequent secure mountings of peripheral walls, floors, and floor trusses.

Thereafter, upper ends of top cord bearing type floor trusses may hang upon and may be supported within the step spaces or insets which have been molded at the upper ends and interior peripheries of the formed basement walls. Such configuration advantageously allows the lower surface of a building's flooring to be immediately supported by a combination of the extreme upper and outer surfaces of the basement or foundation walls and the co-planar upper surfaces of the floor trusses' top cords. Such dual modes of undersupport of the flooring advantageously raises the upper surface of the floor to an elevation substantially equal to that of the upper end of the foundation wall. Where the building's floor sheathing comprises, for example, ¾" plywood, the instant invention advantageously raises the first floor to an elevation no higher than ¾" above the foundation.

The instant inventive assembly also advantageously allows first story outer wall sill plates to be positively bolted against the upper surface of the flooring at the outer periphery of the flooring. Such enabled mode of outer wall fastening advantageously allows tornadic winds to tear away the building's upper stories while leaving flooring clamped in place for continued service as a protective basement roof.

Accordingly, objects of the instant invention include provisions of assembly structures and performance of construction and fabrication steps, as described above, for the achievement of benefits and advantages, as described above.

Other and further objects, benefits, and advantages of the instant invention will become known to those skilled in the art upon review of the Detailed Description which follows, and upon review of the appended drawings.

DETAILED DESCRIPTION OF PREFERRED EMBODIMENTS AND MODES OF PERFORMANCE

Figure 1:
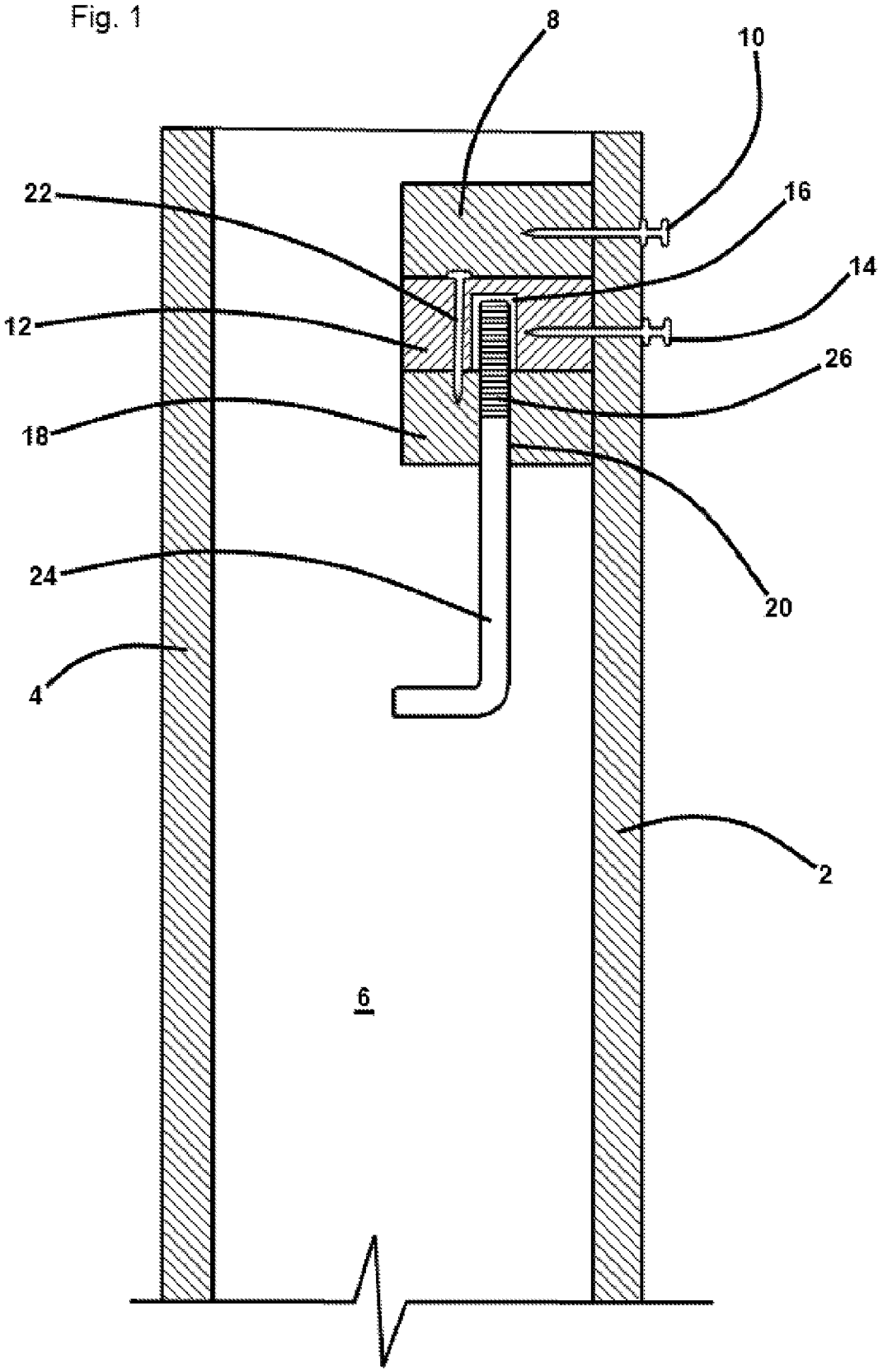
FIG. 1 is a sectional view of initial concrete forming assemblies which are constructed and provided in accordance with the instant invention.

Referring now to the drawings, and in particular to Drawing FIG. 1, concrete basement wall or foundation wall forming sheathings or panels 2 and 4 are preferably vertically positioned and supported at a construction site in a fashion commonly known in the basement wall fabricating arts, such panels 2 and 4 forming and defining a concrete basement wall casting space 6. Alternatively, such space 6 may be utilized for casting and forming the building's shorter crawl space wall where no basement is to be provided.

Prior to erection of the interior panel layer 2 at the vertically oriented position depicted in FIG. 1, pluralities of truss hanger or tongue step or recess molding boards 8 and 12 are removably attached to the interior upper ends of panels 2, suitably by means of nails 10 and 14. In the preferred embodiment, mounting lug clearance sockets 16 are drilled into the lower surface of hanger step molding boards 12.

Referring further to FIG. 1, following the temporary installations of the step molding boards 8 and 12, a first or inner plurality of truss bearing sill plates 18 are removably attached to the undersurfaces of the undersurfaces of step molding boards 12, such sill plates 18 functioning as lowermost step molding boards, the sill plates' attachments being suitably effected by means of nails 22. In the preferred embodiment, an inner plurality of closely fitted and evenly spaced bolt receiving channels 20 are vertically drilled through the sill plates 18, such channels 20 preferably being positioned to directly underlie pre-drilled clearance sockets 16. Thereafter, a first or inner plurality of concrete anchoring "L" bolts 24 having upper helical threads 26 may be driven upwardly through channels 20 until such bolts' upper ends protrude into the downwardly opening sockets 16.

Figure 2:
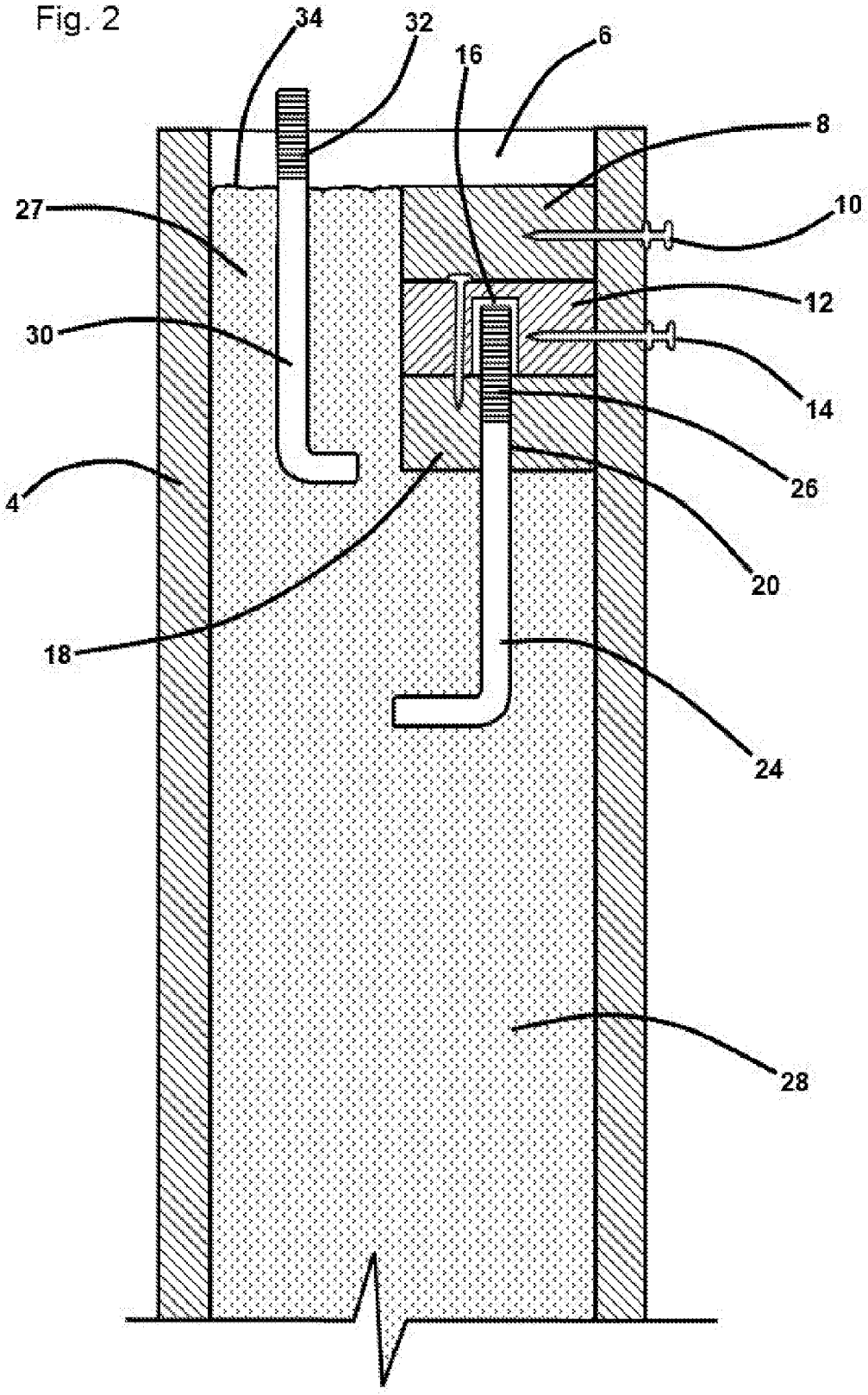
FIG. 2 redepicts FIG. 1, the view of FIG. 2 further showing poured concrete and an additionally installed second plurality of "L" bolts.

Thereafter, referring simultaneously to FIGS. 1 and 2, concrete 28 may be poured from above into casting space 6 until the upper surface 34 of the concrete 28 rises to the level of the upper surface of the uppermost hanger step molding board 8. Thereafter, and prior to concrete hardening, a second or outer plurality of "L" bolts 30 having upper helical threads 32 may be extended downwardly into the concrete 28, such bolts being positioned upwardly and outwardly with respect to the inner "L" bolts 24. Suitably, a plurality of wedge anchor bolts (not depicted) may be installed in place of bolts 30 subsequent to concrete hardening.

Figure 3:
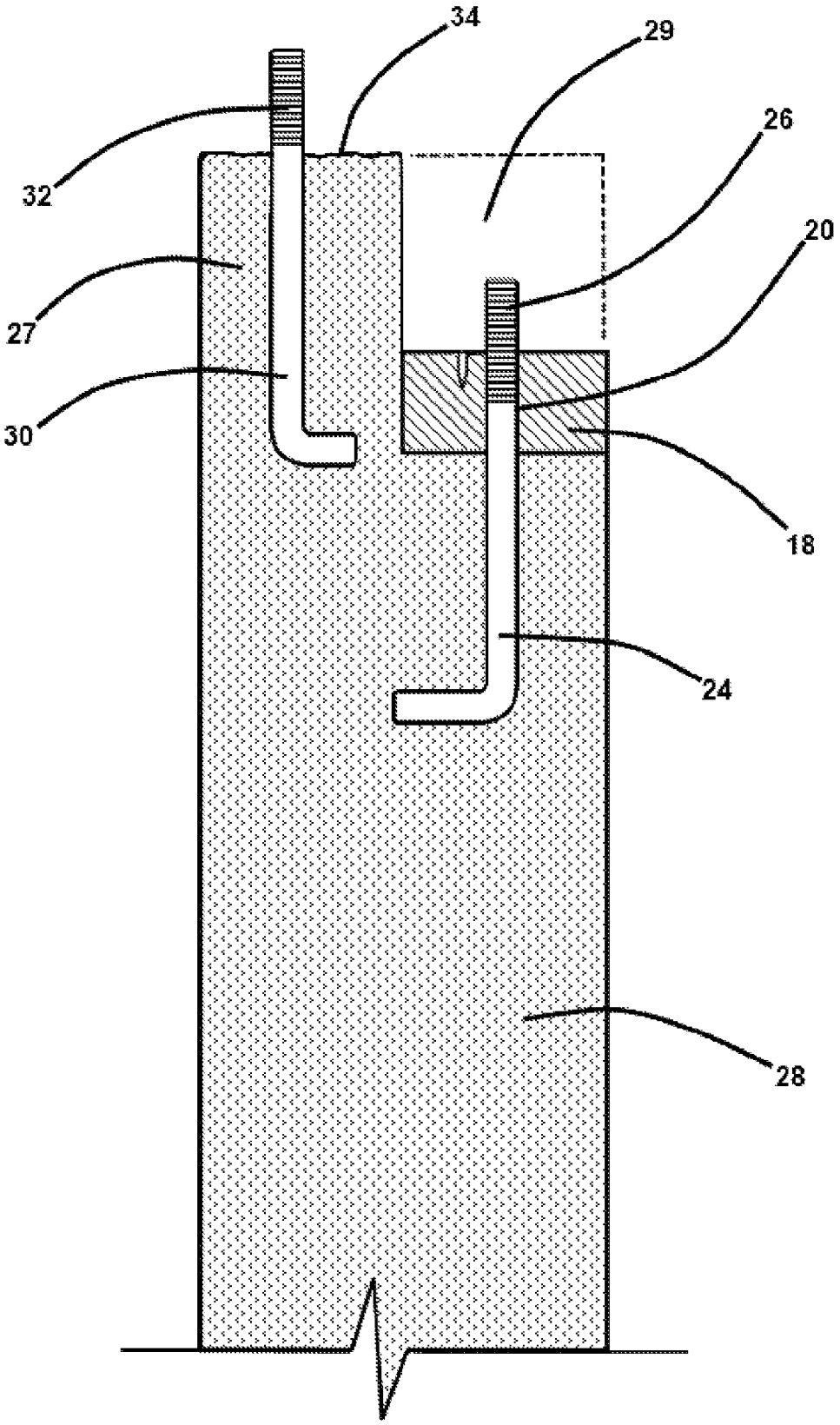
FIG. 3 redepicts the structures of FIGS. 1 and 2, the view of FIG. 3 showing concrete forming components removed.

Referring simultaneously to FIGS. 1-3, following hardening of the concrete 28, external and internal panel forms 4 and 2 may be laterally removed, and the upper hanger step molding boards 8 and 12 may be upwardly removed. Such molding board removals advantageously leave the truss bearing sill plates 18 securely embedded in place and leave "L" bolts 30 and 24 secured in place.

Figure 4:
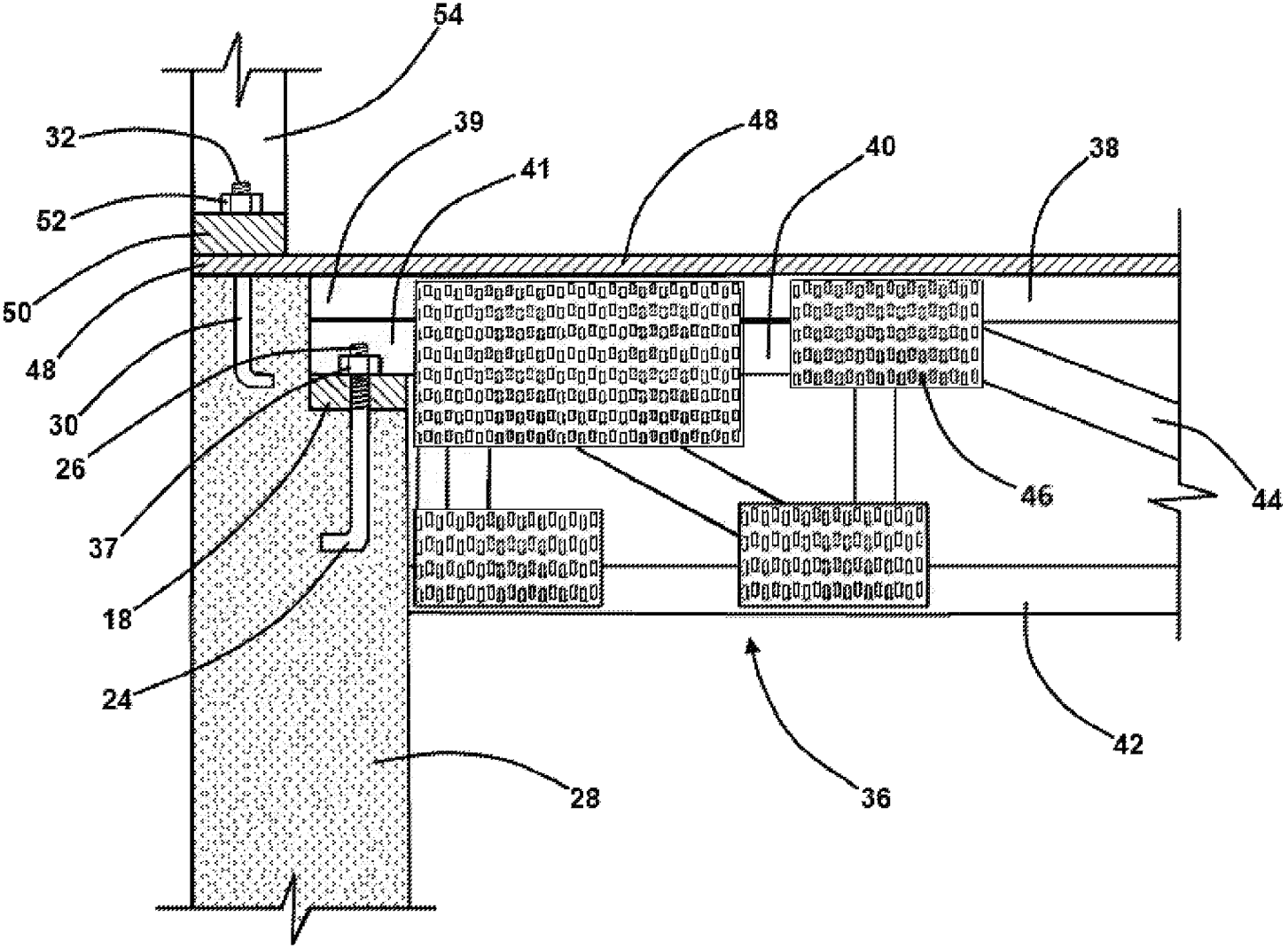
FIG. 4 redepicts the structure FIG. 3, the view of FIG. 4 further showing a top cord bearing floor truss, flooring, and a peripheral upper story wall.
Figure 5:
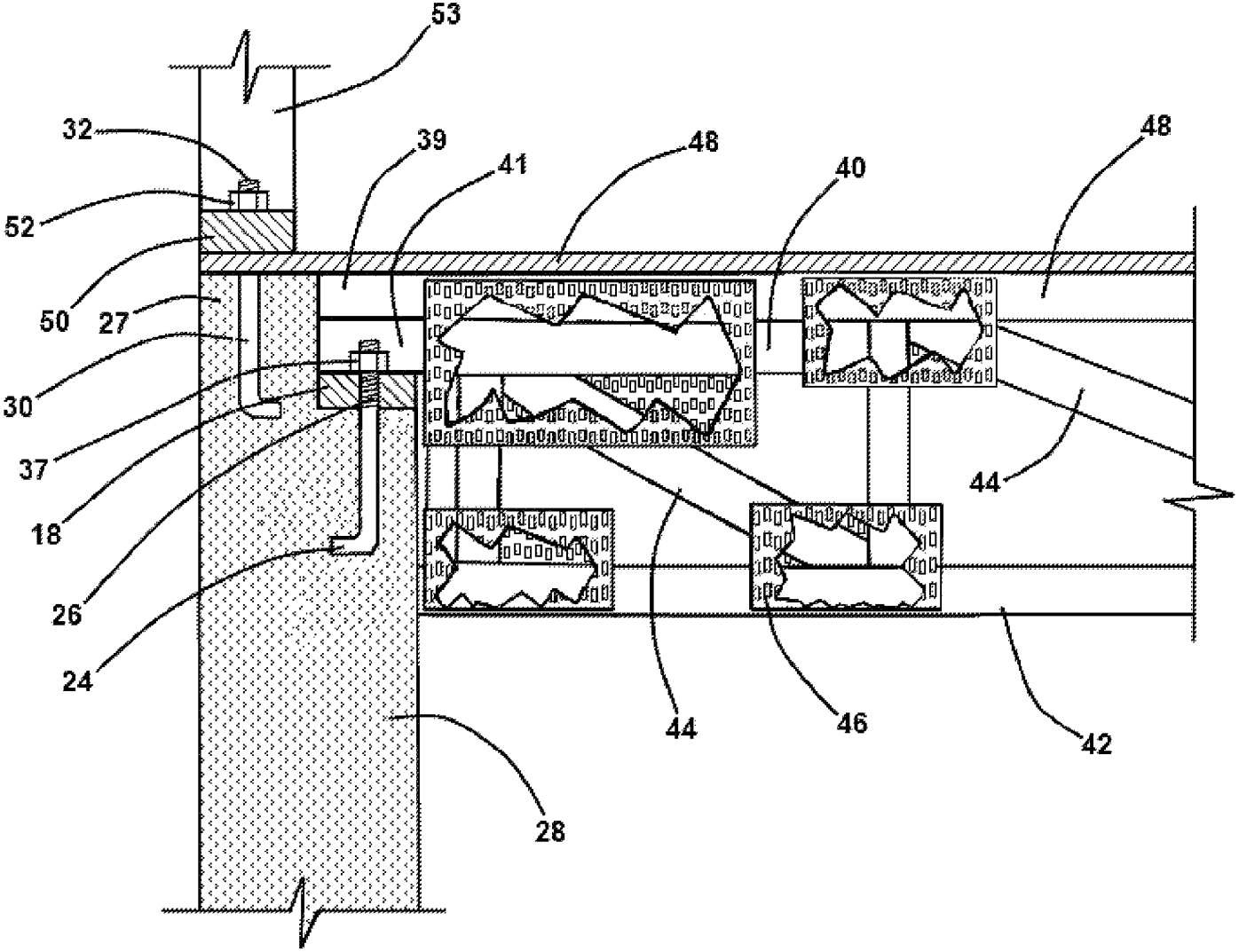
FIG. 5 redepicts the structure of FIG. 4, the view of FIG. 5 including cutaways for views of structure beneath gang nail fasteners.

Thereafter, referring simultaneously to FIGS. 3-5, a plurality of top cord bearing trusses 36 may be provided in sufficient number to overspan basement space 60 at even parallel 18" or 24" intervals. Trusses 36 preferably have upper and lower cords 38 and 42 and incorporate triangulating web members 44. Such trusses' upper cords 38 preferably extend laterally or horizontally outwardly beyond the ends of such trusses' lower cords 42, such excess lateral extensions advantageously forming suspension or hanger tongues 39,41 at the trusses' opposite ends. In the preferred embodiment, hanger tongue reinforcing boards 40 whose outer ends 41 directly underlie and buttress tongues 39 are provided, such reinforcing members allowing the trusses 36 to securely suspend from their upper cords 38. Gang nail fasteners 46 securely interconnect the web 44, the cords 38 and 42, and the tongue reinforcement boards 40.

Referring simultaneously to FIGS. 3 and 4, the hanger or tongue receiving step or recess 29 is preferably closely fitted for receiving and securely containing the top cord tongues 39,41 of the trusses 36 so that the lower surfaces of the tongues 39,41 may directly bear against the upper surface of sill plates 18, and so that the upper surfaces of the tongues 39,41 may reside at an elevation substantially equal to or co-planar with the upper surface 34 of the outer flange 27 of the basement wall 28. In such sizing, the vertical height of the outer flange 27 is preferably substantially equal to the combined vertical heights of the top cord tongue 39,41 and the inner sill plate 18. Such sizing of the tongue recess 29 and flange 27 advantageously allows floor board sheathing 48 to directly rest upon and be supported by both the upper surfaces of the upper cords 38 of the trusses 36, and by the upper surface 34 of the outer flange 27 of the peripheral basement walls 28. Such co-planar configuration advantageously supports the floor sheath 48 at an elevation as low as the upper surface 34 of the basement wall while solidly undergirding the floor sheath 48 via trusses 36 which have a large vertical dimension. Where, for example, the trusses 36 have a two foot vertical dimension, standardized basement walls may be configured to extend upwardly approximately ten feet from a basement floor slab. Upon such construction, ample interstitial spaces between the trusses 36 for installation of heating and air conditioning duct work is provided.

Referring to FIGS. 3 and 4, it can be seen that provision of the molded tongue receiving recess 29 correspondingly presents an outer upwardly extending flange 27. Such flange 27 advantageously dually functions as a wall supporting pedestal and as a rim joist which closes outward openings between trusses 36.

The inventive configuration, as depicted in FIG. 4, additionally advantageously allows the assembly's second plurality of or outer/upper "L" bolts 30 to extend both through apertures within the floor sheathing 48 and through aligned apertures within peripheral or outer sill plates 50. Upon fastening of such outer sill plates 50 by means of helically threaded nuts 52 which engage outer "L" bolt helical threads 32, the outer periphery of the floor 48 is advantageously securely clamped to the basement wall 28. Such floor clamping apparatus and function of the instant invention advantageously assures that in the event of tornadic winds, above ground walls represented by wall stud 54 may be harmlessly peeled away from the house. The instant inventive assembly and construction method advantageously allows such winds to break the house at ground level, while leaving floor sheathing 48 and underlying trusses 36 in place and intact for continued service as a protective "backup roof" which covers persons sheltering within the basement space 60. Nailing of the tongue components 39,41 directly to the interior and lower sill plates 18 may further secure the flooring 48 in place over space 60, further assuring that floor 48 serves as a backup roof structure. The tongues 39,41 may be further or alternately secured by means of helically threaded nuts 37 which engage bolts 24 and at least clamp against sill plates 18.

While the principles of the invention have been made clear in the above illustrative embodiment, those skilled in the art may make modifications in the structure, arrangement, portions, and components, of the invention or may make modifications to the method steps including their identity, character, and sequence of performance without departing from those principles. Accordingly, it is intended that the description and drawings be interpreted as illustrative and not in the limiting sense, and that the invention be given a scope commensurate with the appended claims.

The invention hereby claimed is:

1. An apparatus for clamping a floor, the floor comprising a plurality of truss top cords having tongue configured cord ends, the floor further comprising a sheath attached to the truss top cords, the sheath having an undersurface and a plurality of bolt receiving apertures, the apparatus for clamping the floor comprising:

(a) a cast concrete foundation wall having a stepped upper end, the stepped upper end comprising an outer flange and an inner tongue recess, the outer flange having a horizontal upper surface in contact with the sheath's undersurface;

(b) an outer plurality of helically threaded bolts fixedly anchored within and extending upwardly from the outer flange, said bolts being positioned for, upon receipt of the tongue configured cord ends within the inner tongue recess, vertically extending through the sheath's bolt receiving apertures; and (c) an outer plurality of helically threaded nuts fitted for threaded engagements with the outer plurality of helically threaded bolts, said nuts upon receipt by the vertically threaded bolts, clamp the sheath against the outer flange's horizontal upper surface and capture the tongue configured cord ends within the inner tongue recess.

2. The apparatus for clamping a floor of claim 1 further comprising an outer plurality of sill plates having a plurality of bolt receiving apertures positioned for overlying alignment with the sheath's plurality of bolt receiving apertures, the outer plurality of sill plates being positionable in receipt of the helically threaded bolts and beneath the outer plurality of helically threaded nuts.

3. The apparatus for clamping a floor of claim 2 further comprising an inner plurality of helically threaded bolts fixedly anchored within the cast concrete foundation wall, each bolt among the inner plurality of helically threaded bolts extending upwardly into the inner tongue recess.

4. The apparatus for clamping a floor of claim 3 further comprising an inner plurality of sill plates having a plurality of bolt receiving apertures, the inner sill plates' plurality of bolt receiving apertures being positioned for receipt of the inner plurality of helically threaded bolts, the inner sill plates being positionable in receipt of the inner plurality of helically threaded bolts and beneath the tongue configured cord ends.

5. The apparatus for clamping a floor of claim 4 further comprising an inner plurality of helically threaded nuts fitted for threaded engagement with the inner plurality of helically threaded bolts, the inner plurality of helically threaded nuts, upon the positioning of the inner plurality of sill plates in receipt of the inner plurality of helically threaded bolts and beneath the tongue configured cord ends, and upon their threaded engagement with the inner plurality of helically threaded bolts, securing the inner plurality of sill plates within the inner tongue recess.

6. The apparatus for clamping a floor of claim 5 wherein each bolt among the inner plurality of helically threaded bolts comprises a concrete anchoring "L" bolt.

7. The apparatus for clamping a floor of claim 5 further comprising a rim joist positioned for closing outwardly opening spaces, the outwardly opening spaces being defined by the truss top cords, the rim joist comprising the cast concrete foundation wall's outer flange.

8. The apparatus for clamping a floor of claim 5 wherein the cast concrete foundation wall's outer flange has a vertical height, wherein each sill plate among the inner plurality of sill plates has a vertical height, wherein each tongue configured cord end has a vertical height, and wherein the outer flange's vertical height is substantially equal to the sum of the vertical heights of one of the inner sill plates and one of the tongue configured cord ends.

* * * * *